US007539434B2

(12) United States Patent
Ogino et al.

(10) Patent No.: US 7,539,434 B2
(45) Date of Patent: May 26, 2009

(54) IMAGE FORMING APPARATUS AND METHOD FOR USE WITH AN EXTERNAL CONTROLLER

(75) Inventors: Noboru Ogino, Mishima (JP); Yasuhiro Kojima, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 267 days.

(21) Appl. No.: 11/460,894

(22) Filed: Jul. 28, 2006

(65) Prior Publication Data

US 2008/0025748 A1 Jan. 31, 2008

(51) Int. Cl.
*G03G 15/00* (2006.01)

(52) U.S. Cl. ..... 399/82; 399/81; 399/87

(58) Field of Classification Search ..... 399/81, 399/82, 83, 85, 87

See application file for complete search history.

(56) References Cited

U.S. PATENT DOCUMENTS

2001/0048823 A1* 12/2001 Nomura et al. ..... 399/80

FOREIGN PATENT DOCUMENTS

JP 2003-196056 7/2003

* cited by examiner

*Primary Examiner*—Hoang Ngo
(74) *Attorney, Agent, or Firm*—SoCal IP Law Group LLP; Steven C. Sereboff; John E. Gunther

(57) ABSTRACT

An image forming apparatus of an example of the invention includes first connecting means for receiving image data, second connecting means for receiving control information for subjecting the image data to output control, the control information corresponding to the image data, third connecting means for communicating first print job information of the image data, and a display unit that displays the first print job information received by the third connecting means.

15 Claims, 7 Drawing Sheets

<Before suspension>

| |
|---|
| Martini. doc |
| Alexander. xls |
| Black Velvet. ppt ← Suspend |
| Bellini. pdf |
| Alaska. txt |
| Stinger. mpp |

<After suspension>

| |
|---|
| Martini. doc |
| Alexander. xls |
| Not printed until printing is resumed Black Velvet. ppt |
| Bellini. pdf ← Printed ahead of preceding job |
| Alaska. txt |
| Stinger. mpp |

FIG. 7

IMAGE FORMING APPARATUS AND METHOD FOR USE WITH AN EXTERNAL CONTROLLER

BACKGROUND OF THE INVENTION

1. Field of the Invention

The present invention relates to an image forming apparatus and an image forming method for performing various kinds of processing on the basis of setting for various kinds of processing such as copying, facsimile transmission, scanning, or image filing.

2. Description of the Related Art

As it is well known, in recent years, there is an image forming apparatus that has plural functions such as a copy function, a facsimile function, a scanner function, a printer function, or an image filing function. Such an image forming apparatus is connected to, for example, an arbitrary number of personal computers (hereinafter referred to as PCs) and the outside via a network. Therefore, it is possible to capture data, which is captured by the image forming apparatus, into the PCs and transmit the data to the outside.

Conventionally, in the image forming apparatus that has plural functions such as a copy function, a facsimile function, a scanner function, a printer function, or an image filing function, a control panel is provided. A user performs various kinds of setting on the control panel. The user is also capable of applying the same setting as the setting on the control panel of the image forming apparatus such as conversion of a file format and instruction of copying to data stored in the image forming apparatus from a PC of a user.

Since such an image forming apparatus is connected to the arbitrary number of PCs via the network, the image forming apparatus receives print jobs for requesting printing from the respective PCs and sequentially processes plural print jobs received.

JP-A-2003-196056 discloses a constitution in which a printer receives, for one job, information such as image data from an application server, receives page control information such as output resolution and the number of prints from a client computer connected to the printer via a network, and combines the information and the page control information in the printer.

However, in the invention disclosed in JP-A-2003-196056, two interfaces, that is, an interface for transferring image data and an interface for transferring page control information are provided between the printer and a print controller. However, only information of one print job can be shared between the printer and the print controller. Thus, deletion of a job put in queuing by the controller cannot be performed from the printer side.

BRIEF SUMMARY OF THE INVENTION

It is an object of the invention to provide an image forming apparatus that can efficiently perform various kinds of processing and has high operability.

In order to attain the object of the invention, an image forming apparatus of the invention includes: first connecting means for receiving image data; second connecting means for receiving control information for subjecting the image data to output control, the control information corresponding to the image data; third connecting means for communicating first print job information of the image data; and a display unit that displays the first print job information received by the third connecting means.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

FIG. 7 is a diagram showing information displayed on the control panel of the image forming apparatus according to the embodiment of the invention.

DETAILED DESCRIPTION OF THE INVENTION

Figure 1:
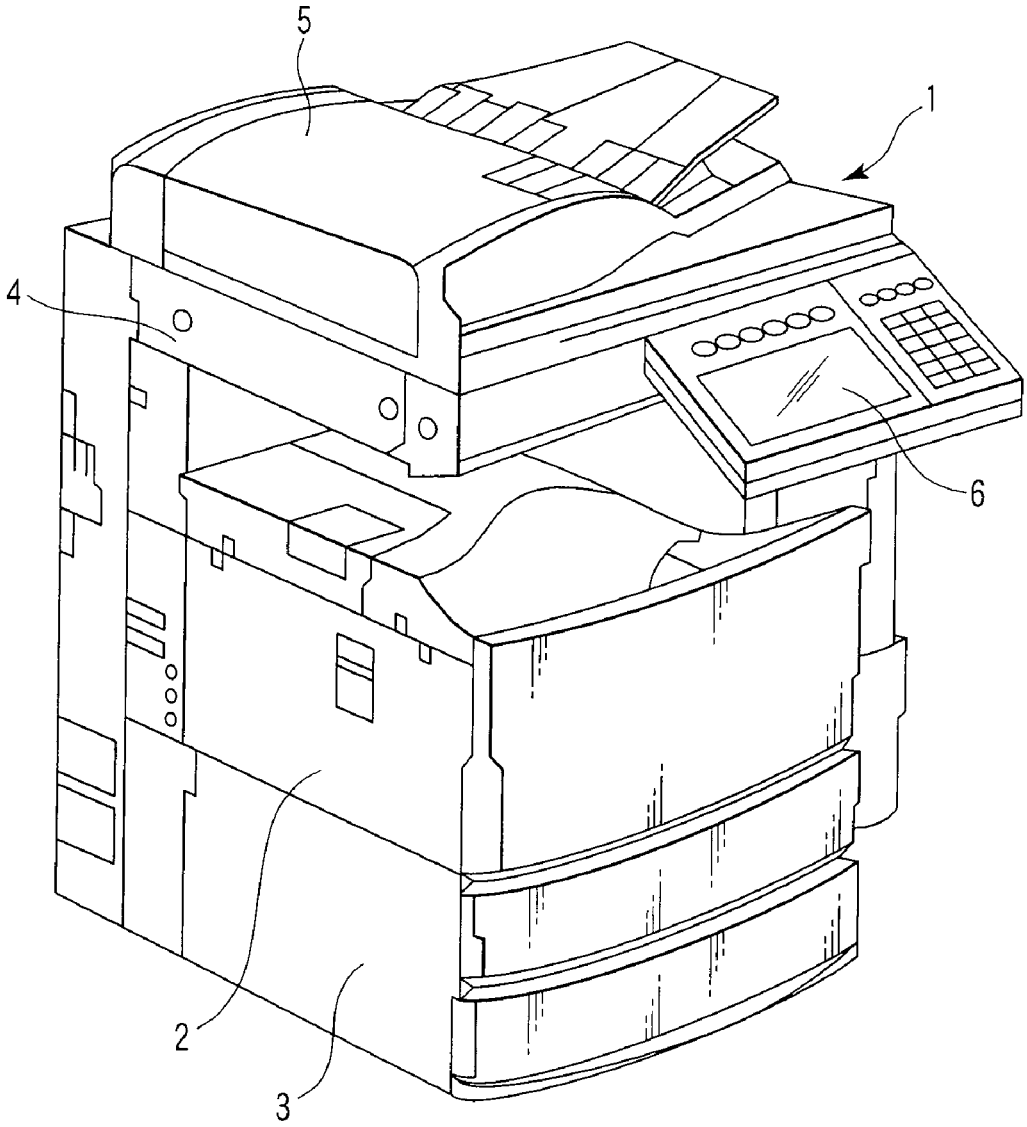
FIG. 1 is a diagram showing an external appearance of an image forming apparatus according to an embodiment of the invention.

An embodiment of the invention will be hereinafter explained with reference to the drawings. FIG. 1 shows a main part of an image forming apparatus to which the invention is applicable.

An image forming apparatus 1 shown in FIG. 1 includes an image forming unit body 2 for outputting image information as an output image referred to as, for example, hard copy or printout, a sheet feeding unit 3 capable of feeding a sheet (an output medium) of an arbitrary size used for image output to the image forming unit body 2, and a scanner unit (an image reading unit) 4 that captures image information, which is an object subjected to image formation in the image forming unit body 2, as image data from an object that holds the image information (hereinafter referred to as original). An automatic document feeder 5 that discharges, when an original is a sheet-like original, after formation of an image output or capture of image information (hereinafter referred to as reading) ends, the original, for which the reading ends, from a reading position to a discharge position and guides the next original to the reading position is integrally provided in the scanner unit 4. An instruction input unit, that is, a control panel (an operation unit) 6 for instructing start of image formation in the image forming unit body 2 and start of reading of image information of an original by the scanner unit 4 is provided in a predetermined position of the image forming apparatus 1, for example, at an end of a front surface of the image reading unit 4.

Figure 2:
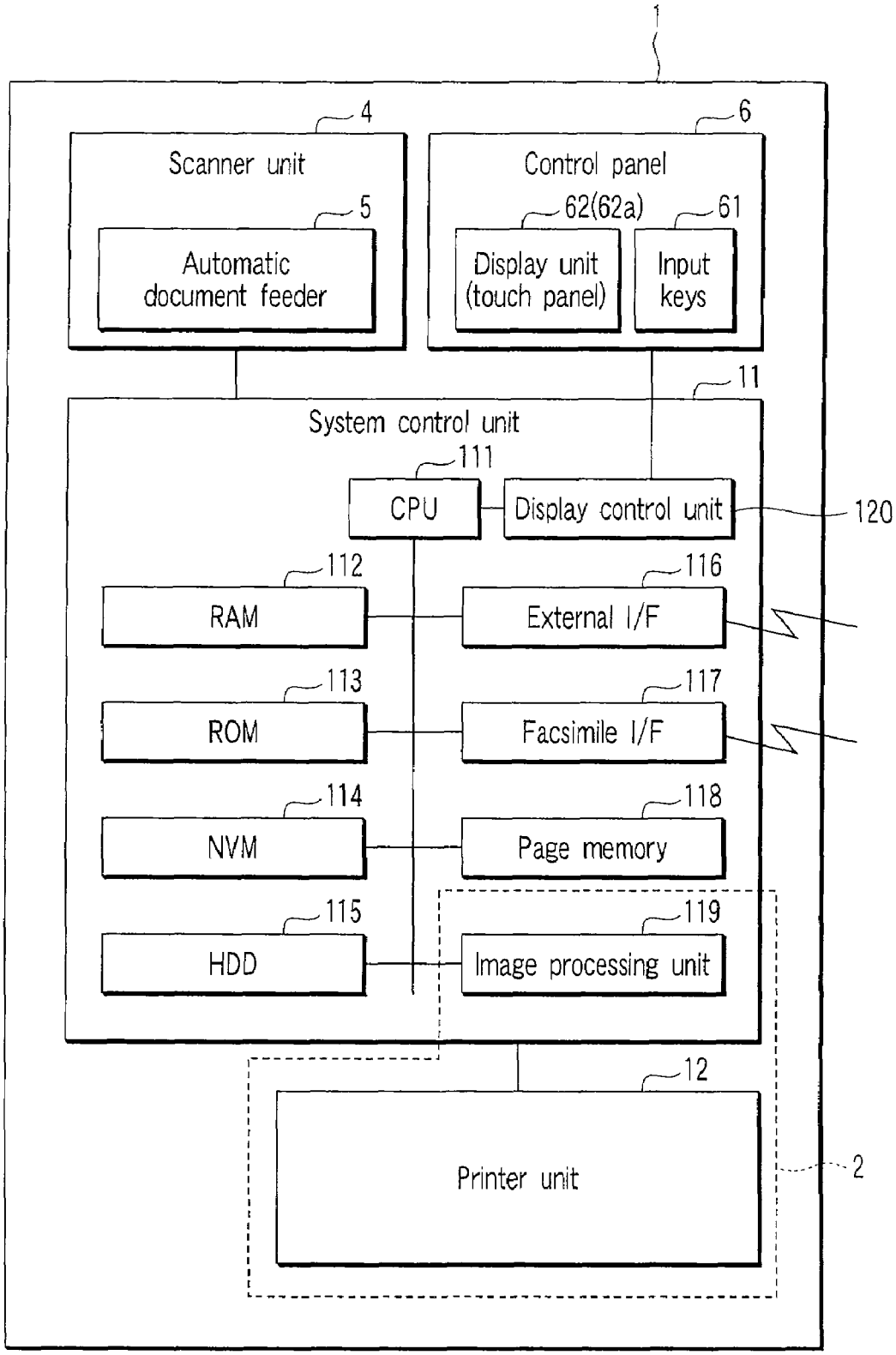
FIG. 2 is a block diagram showing a structure of the image forming apparatus according to the embodiment of the invention.

FIG. 2 is a block diagram showing a structure of a control system of the image forming apparatus to which the invention is applicable. As shown in FIG. 2, in this image forming apparatus 1, the control panel 6, the scanner unit 4, and a printer unit 12 are connected to a system control unit 11.

The system control unit 11 controls the control panel 6, the scanner unit 4, the printer unit 12, and the like. The system control unit 11 has various functions for performing various kinds of processing on the basis of signals supplied from the control panel 6, the scanner unit 4, and the printer unit 12.

The control panel 6 has input keys 61, a display unit 62 having a touch panel 62*a* built therein, and the like. An operation guide, keys (icons) selectable with the touch panel 62*a*, and the like are displayed on the display unit 62 on the basis of display control by the system control unit 11. On the control panel 6, a user can input icons selectable with the input keys 61 or the touch panel 62*a*. Information inputted by the user on the control panel 6 (information indicating icons selectable with the input keys 61 pressed by the user or the touch panel 62*a* touched by the user) is supplied to the system control unit 11.

The scanner unit 4 converts an image of an original into image data on the basis of the control by the system control unit 11. The scanner unit 4 converts the image of the original into color or monochrome digital image data. The scanner unit 4 supplies the digital image data serving as the image of the original read to the system control unit 11.

The printer unit 12 prints an image on a sheet serving as an image formation medium on the basis of the control by the system control unit 11. A result or the like of print processing by the printer unit 12 is notified to the system control unit 11. The printer unit 12 performs color printing for forming a color image on the image formation medium on the basis of color image data or monochrome printing for forming a monochrome image on the image formation medium on the basis of monochrome image data.

The system control unit 11 includes, as shown in FIG. 2, a CPU (Central Processing Unit) 111, a RAM (Random Access Memory) 112, a ROM (Read Only Memory) 113, an NVM (Non-volatile memory) 114, a hard disk drive (HDD) 115, an external interface 116, a facsimile interface 117, a page memory 118, an image processing unit 119, a display control unit 120, or the like.

The CPU 111 executes a program stored in the ROM 113, the nonvolatile memory 114, or the HDD 115. For example, the automatic document feeder 5 is realized by the CPU 111 executing a control program on the basis of a program and control data stored in the ROM 113, the NVM 114, or the HDD 115. The CPU 111 executes display control of the display unit 62 in the control panel 6 on the basis of a program and control data stored in the NVM 114 or the ROM 113.

The RAM 112 is a memory for temporarily storing data for work and storing data for reference. The RAM 112 is used as a main memory for executing various kinds of processing based on various control programs. For example, a control program and control data are read out to the RAM 112 at the time of an operation of the digital multifunction peripheral. At the same time, the RAM 112 stores information and the like that should be temporarily stored such as information indicating present setting content.

As the setting content, for example, in a copy mode, there are a copy magnification, the number of copies, and the like in addition to original setting and sheet setting.

The ROM 113 is a nonvolatile memory. For example, a control program, control data, and the like for controlling the image forming apparatus 1 are stored in the ROM 113. Display data and the like displayed on the display unit 62 of the control panel 6 may be stored in the ROM 113.

The NVM 114 is a rewritable nonvolatile memory. Data such as system setting information is stored in the NVM 114. Display data and the like displayed on the display unit 62 of the control panel 6 may be stored in the NVM 114.

The HDD 115 is a large capacity storage device. Various data such as various setting data, management data, control program, and control data are stored in the HDD 115. Display data and the like displayed on the display unit 62 of the control panel 6 are also stored in the HDD 115. Image data and the like read by the scanner unit 4 are also stored in the HDD 115. Moreover, the HDD 115 may be used as a backup memory for various memories.

The external interface 116 has plural interfaces. The external interface 116 is connected to plural interfaces of an external controller 200 (see FIG. 3) externally connected, respectively, and communicates data to the interfaces. In the image forming apparatus 1, a network print function for printing print data from an external controller, which is connected to the image forming apparatus 1 by the external interface 116, on a sheet is realized.

The facsimile interface 117 is an interface for transmitting and receiving facsimile data. In the image forming apparatus 1, a facsimile function is realized using the facsimile interface 117. For example, facsimile reception processing is realized by monochrome-printing facsimile data received by the facsimile interface 117 using the printer unit 12. Facsimile transmission processing is realized by converting image data of an original read by the scanner unit 4 into facsimile data and transferring the facsimile data to a transmission destination using the facsimile interface 117.

The page memory 118 is a memory in which image data and the like to be printed by the printer unit 12 are stored. For example, when the printer unit 12 performs print processing, color image data or monochrome image data of respective pages, which should be printed by the printer unit 12, is expanded (stored) in the page memory 118.

For example, the image processing unit 119 subjects data scanned by the scanner unit 4 to smoothing processing and performs high-image quality processing for printout.

The display control unit 120 controls a screen to be displayed on the display unit 62. The display control unit 120 reads out a program and control data stored in the NVM 114 or the ROM 113 and displays a screen on the basis of input information of icons selectable with the input keys 61 or the touch panel 62*a* by a user.

Figure 3:
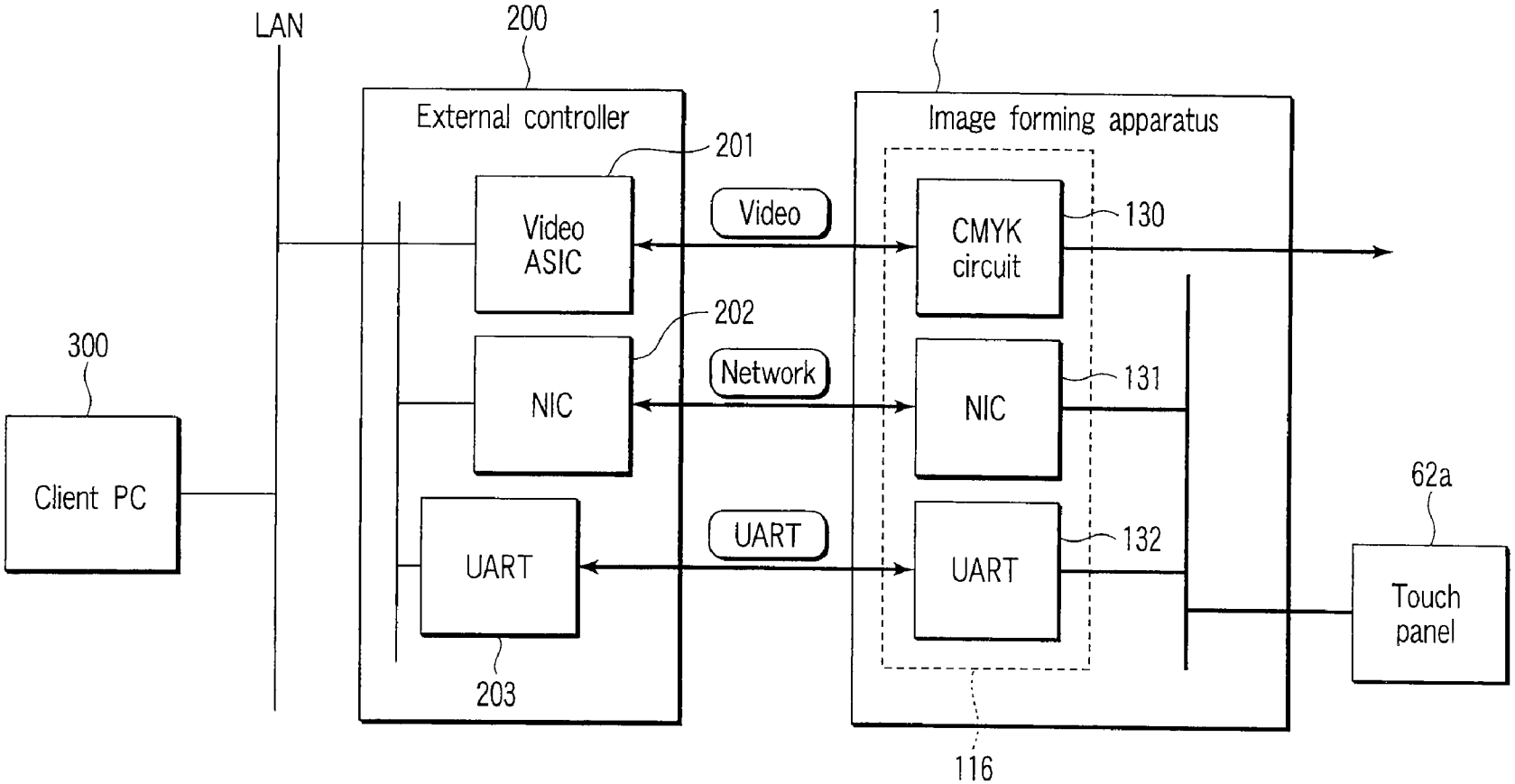
FIG. 3 is a block diagram showing structures of the image forming apparatus and an external controller according to the embodiment of the invention.

Connection of a client PC, an external controller, and an image forming apparatus will be explained using FIG. 3.

Plural client PCs 300 are connected to the external controller 200 via a LAN. The external controller 200 is connected to the image forming apparatus 1 and controls the image forming apparatus 1 in response to a request from the client PC 300.

Processing in the image forming apparatus 1 at the time when the user requests printing of image data using the client PC 300 will be explained.

The user can request, using a printer driver, printing of a document or the like created by an application of the client PC 300. The external controller 200 receives print data from the client PC 300 via the LAN and generates image data and control information corresponding to the image data set by the user. The control information corresponding to the image data is, for example, information not depending on the image data such as resolution and the number of outputs and is information changeable by the user.

The external controller 200 has plural interfaces, namely, a Video ASIC 201 (Video Application Specific Integrated Circuit), a NIC 202 (Network Interface Card), and a UART 203 (Universal Asynchronous Receiver Transmitter). The Video ASIC 201 is a video interface for transferring image data generated by the external controller to the image forming apparatus 1. The UART 203 is a UART interface for transferring control information corresponding to the image data to the image forming apparatus 1. The NIC 202 is a network interface for transmitting and receiving print information and internal information of the image forming apparatus 1. The print information is print job information displayed on the control panel 6 of the image forming apparatus 1 such as a file name and the number of prints of image data requested to be printed from the client PC 300. The internal information of the image forming apparatus 1 is operation information of the image forming apparatus 1, information on a residual amount of toner, and the like.

The Video ASIC 201 of the external controller 200 is connected to a CMYK circuit 130, which is a video interface of the image forming apparatus 1, by a VIDEO cable. The UART 203 of the external controller 200 is connected to a UART 132, which is a UART interface of the image forming apparatus 1, by a UART cable. The NIC 202 of the external controller 200 is connected to a NIC 131, which is a network interface of the image forming apparatus 1, by a NETWORK cable (a LAN cable in this embodiment).

The image forming apparatus 1 outputs image data received by the CMYK circuit 130 from the printer unit 12 on the basis of control information corresponding to image data received by the UART 132. Print job information received by the NIC 131 is displayed on the touch panel 62*a* of the control panel 6.

When plural print requests are sent from the client PC 300, the external controller 200 stores image data requested by the plural print requests and control information corresponding to the image data in a not-shown storing unit provided in the external controller 200. The external controller 200 controls the image data and the image data such that the image data can be transmitted to the image forming apparatus 1 via the VIDEO cable and the UART cable in an order of the print requests.

The external controller 200 creates a print job, which is information indicating a file name, the number of prints, and the like, on the basis of the image data requested to be printed from the client PC 300 and the control information corresponding to the image data. The external controller 200 transmits plural print jobs to the image forming apparatus 1 via the NETWORK cable that connects the NIC 202 of the external controller 200 and the NIC 131 of the image forming apparatus 1. The image forming apparatus 1 displays the plural print jobs received on the control panel 6.

The external controller 200 puts the image data and the control information corresponding to the image data stored in the not-shown storing unit on standby in the storing unit of the external controller 200 until a print order of the image data comes.

Figure 4:
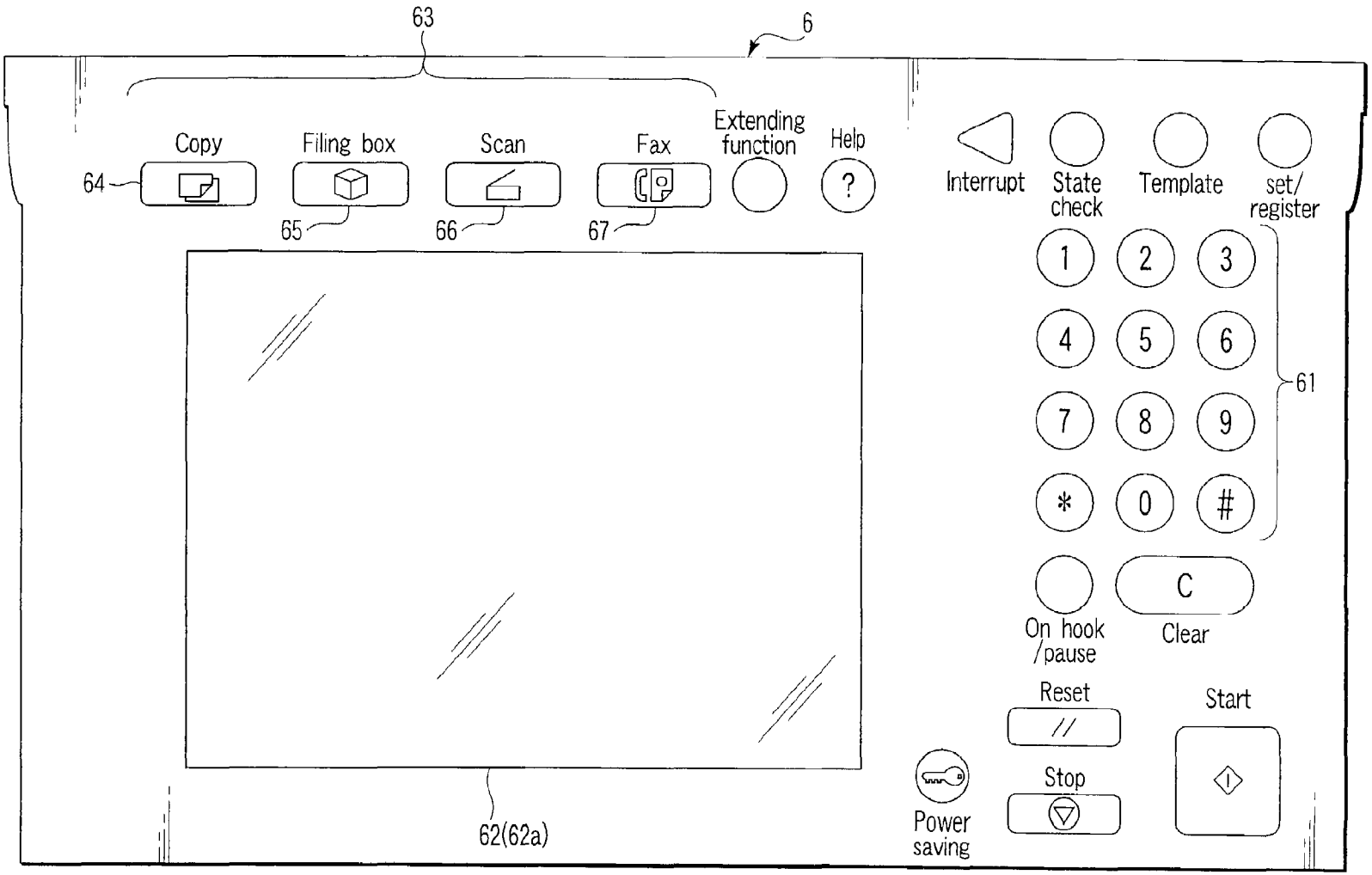
FIG. 4 is a diagram showing an external appearance of a control panel of the image forming apparatus according to the embodiment of the invention.

A structure of the control panel 6 will be explained. FIG. 4 is an external view for explaining an example of the structure of the control panel 6. As shown in FIG. 4, an input keys 61, the display unit 62 having the touch panel 62*a* built therein, function selection keys 63, and the like are provided on the control panel 6.

The function selection keys 63 are keys for selecting various functions. As the function selection keys 63, for example, a copy function selection key 64 for selecting a copy function, a filing box function selection key 65 for selecting a filing function for data, a scan function selection key 66 for selecting a scan function, a FAX function selection key 67 for selecting a facsimile function, a function extension key for selecting other extension functions, and the like are provided.

The input keys 61 are keys for inputting numbers and the like. The input keys 61 are used for inputting information such as the number of copies, a copy magnification, and a password for management.

The display unit 62 is constituted by a liquid crystal display device or the like having the touch panel 62*a* built therein. Various operation screens are displayed on the display unit 62. Keys (icons) selectable with the touch panel 62*a* are displayed on the respective operation screens displayed on the display unit 62 in addition to an operation guide and the like.

The display control unit 120 of the system control unit 11 judges content of operation by the user or display content corresponding to operation states of the respective units. On the basis of this judgment, the display control unit 120 reads out display data, which should be displayed on the display unit 62, from the NVM 114, the ROM 113, or a not-shown display memory and displays the display data on the control panel 6. In other words, the display control unit 120 subjects the display unit 62 to display control according to content of operation by the user, operation states of the respective units, or the like.

Figure 5:
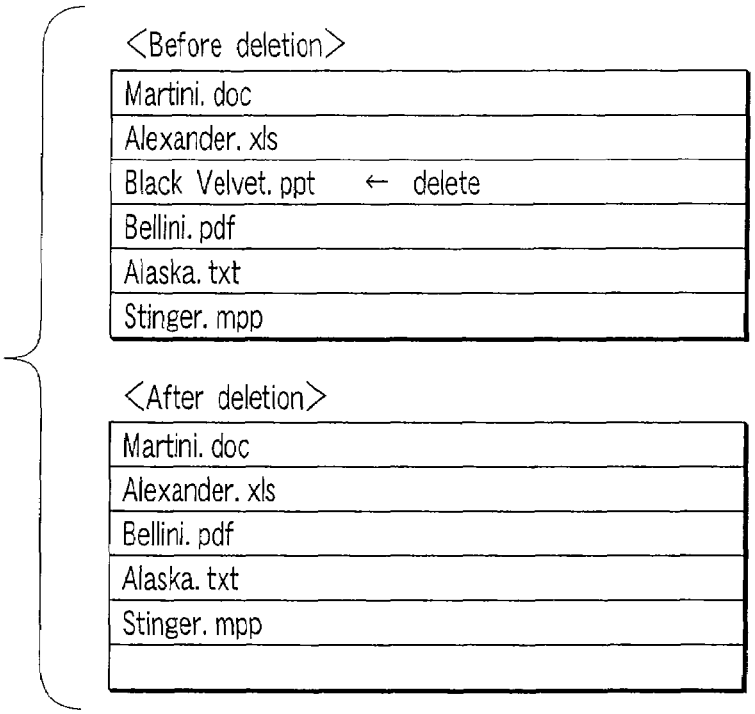
FIG. 5 is a diagram showing information displayed on the control panel of the image forming apparatus according to the embodiment of the invention.

It is assumed that, as shown in FIG. 5, plural print requests are sent from the client PC 300 to the external controller 200. The plural print requests may be sent from an identical client PC 300 or may be sent from different client PCs 300 separately.

When the plural print requests are sent from the client PC 300 to the external controller 200, print jobs are displayed on the control panel 6 in an order of the print requests. For example, it is assumed that plural print requests are sent from the client PC 300 in an order of Martini.doc, Alexander.xls, Black Velvet.ppt, Bellini.pdf, Alaska.txt, and Stinger.mpp. Then, the six files are displayed as print jobs on the control panel 6 of the image forming apparatus 1 according to a print order.

In an example described in this embodiment, only file names are displayed on the control panel 6 as print jobs. The print jobs displayed on the control panel 6 are sequentially updated in such a manner that, for example, when printing of a print job currently being printed ends, display of the print job is deleted. Moreover, when a new print request is sent from the client PC 300, a new print job is additionally displayed under Alaska.txt and Stinger.mpp.

For example, deletion of printing of the file Black Velvet.ppt by the user is explained. The user selects a print job of a file, which the user desires to delete, using the input keys 61 or the touch panel 62*a* of the image forming apparatus 1. For example, as shown in FIG. 5, it is also possible to display characters of the print job selected in a light color to indicate that deletion of the print job is requested.

When the user selects a print job to be deleted, Black Velvet.ppt, the CPU 111 of the image forming apparatus 1 transmits information on deletion of the print job Black Velvet.ppt to the NIC 202 of the external controller 200, which is connected to the image forming apparatus 1 by the NETWORK cable, via the NIC 131 of the image forming apparatus. When the external controller 200 receives the information on deletion of the print job Black Velvet.ppt from the image forming apparatus 1, the external controller 200 deletes image data of Black Velvet.ppt received from the client PC 300 and control information corresponding to the image data from the not-shown storing unit of the external controller 200. When the deletion of the image data of Black Velvet.ppt and the control information corresponding to the image data from the not-shown storing unit of the external controller 200 is completed, the external controller 200 transmits information indicating the remaining print jobs excluding the print job Black Velvet.ppt from the NIC 202 of the external controller 200 to the image forming apparatus 1 via the NETWORK cable. The CPU 111 of the image forming apparatus 1 temporarily stores the information indicating the print jobs received from the external controller 200 in the NVM 114 or the ROM 113. The display control unit 120 of the image forming apparatus 1 subjects the print jobs displayed on the display unit 62 to display control to change a state shown before the deletion in FIG. 5 to a state shown after the deletion.

In other words, the display control unit 120 subjects the print jobs to display control to change to a state in which the print job Black Velvet.ppt is deleted. After the deletion of the print job Black Velvet.ppt, as shown in FIG. 5, Bellini.pdf, Alaska.txt, and Stinger.mpp are moved up in the display of the print jobs.

This makes it possible to delete a file, which is not required to be printed, using the input keys 61 or the touch panel 62*a* of the image forming apparatus 1 without applying loads to the image forming apparatus 1.

Figure 6:
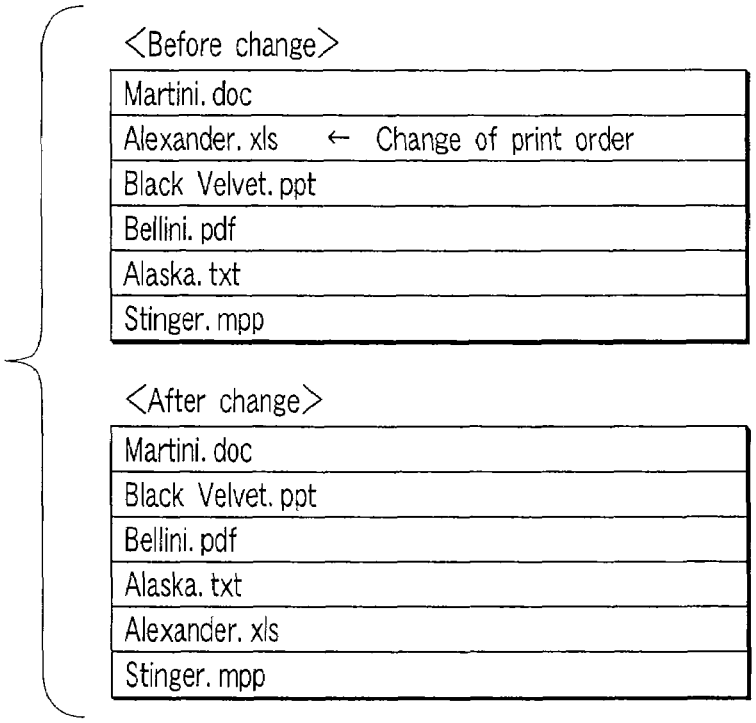
FIG. 6 is a diagram showing information displayed on the control panel of the image forming apparatus according to the embodiment of the invention.

For example, a change of a print order of the file Alexander.xls by the user is explained. The user selects a print job, a print order of which is changed, using the input keys 61 or the touch panel 62*a* of the image forming apparatus 1. For example, as shown in FIG. 6, it is also possible to display characters of the print job selected in a light color to indicate that the change of a print order is requested.

The user selects a print job, a print order of which is changed, Alexander.xls, and sets a print order change to place Alexander.xls after Alaska.txt using the input keys 61 or the touch panel 62*a*.

The CPU 111 of the image forming apparatus 1 transmits information on the print order change of Alexander.xls to the NIC 202 of the external controller 200, which is connected to the image forming apparatus 1 by the NETWORK cable, via the NIC 131 of the image forming apparatus.

When the external controller 200 receives the information on the print order change of the Alexander.xls from the image forming apparatus 1, the external controller 200 sets image data of Alexander.xls and control information corresponding to the image data to be placed after printing of the file Alaska.txt. In other words, the external controller 200 changes a setting to transmit image data of Alaska.txt and control information corresponding to the image data stored in the not-shown storing unit to the image forming apparatus 1 and, then, transmit image data of Alexander.xls and control information corresponding to the image data to the image forming apparatus 1. When the order change for transmitting the image data of Alexander.xls and the control information corresponding to the image data to the image forming apparatus 1 is completed, the external controller 200 transmits information indicating the print jobs after the order change from the NIC 202 of the external controller 200 to the image forming apparatus 1 via the NETWORK cable. The CPU 111 of the image forming apparatus 1 temporarily stores the information indicating the print jobs received from the external controller 200 in the NVM 114 or the ROM 113. The display control unit 120 of the image forming apparatus 1 subjects the print jobs displayed on the control panel 6 to display control to change a state shown before the change in FIG. 6 to a state shown after the change.

In other words, the display control unit 120 subjects the print job Alexander.xls to display control to change the state before the change to a state in which Alexander.xls is placed after Alaska.txt.

This makes it possible to set a print order of a file, which is not required to be printed quickly, later than that in an initial setting using the input keys 61 or the touch panel 62*a* of the image forming apparatus 1 without applying loads to the image forming apparatus 1. It is also possible to set a print order of a file, which is required to be printed quickly, earlier than that in the initial setting using the input keys 61 or the touch panel 62*a* of the image forming apparatus 1 without applying loads to the image forming apparatus 1.

For example, suspension of printing of a file Black Velvet.ppt by the user is explained. The user selects a print job, printing of which is suspended, using the input keys 61 or the touch panel 62*a* of the image forming apparatus 1. For example, as shown in FIG. 6, it is also possible to display characters of the print job selected in a light color to indicate that suspension of printing is requested.

The user selects a print job, printing of which is suspended, Black Velvet.ppt. The CPU 111 of the image forming apparatus 1 transmits information on suspension of printing of Black Velvet.ppt to the NIC 202 of the external controller 200, which is connected to the image forming apparatus 1 by the NETWORK cable, via the NIC 131 of the image forming apparatus.

When the external controller 200 receives the information on suspension of printing of Black Velvet.ppt from the image forming apparatus 1, the external controller 200 sets printing of the file Black Velvet.ppt to be suspended. In other words, the external controller 200 sets image data of Black Velvet.ppt and control information corresponding to the image data stored in the not-shown storing unit of the external controller 200 not to be transmitted to the image forming apparatus 1 even if an order of the print job Black Velvet.ppt comes. The external controller 200 transmits the image data of Bellini.pdf, which is a print job following Black Velvet.ppt, and control information corresponding to the image data to the image forming apparatus.

When the setting for suspending transmission of the image data of Black Velvett.ppt and the control information corresponding to the image data to the image forming apparatus is completed, the external controller 200 transmits information indicating the print jobs after the suspension setting from the NIC 202 of the external controller 200 to the image forming apparatus 1 via the NETWORK cable. The CPU 111 of the image forming apparatus 1 temporarily stores the information indicating the print jobs received from the external controller 200 in the NVM 114 or the ROM 113. The display unit 120 of the image forming apparatus 1 subjects the print jobs displayed on the control panel 6 to display control to change a state shown before the suspension in FIG. 7 to a state shown after the suspension.

In other words, the display control unit 120 displays an indication that printing of the print job Black Velvet.ppt is not resumed until the user instructs resumption of the printing. Since the file Bellini.pdf, which is a print job following the Black Velvet.ppt, is printed earlier than the file Black Velvet.ppt, the display control unit 120 displays an indication that the print job is printed ahead of the preceding job as shown after the suspension in FIG. 6.

This makes it possible to suspend printing of a file with a large size, which is not required to be printed quickly, using the input keys 61 or the touch panel 62*a* of the image forming apparatus 1 without applying loads to the image forming apparatus 1. This is convenient for the user.

For example, immediate printing of a file Alexander.xls by the user is explained. The user is also capable of selecting a print job, printing of which is started immediately, using the input keys 61 or the touch panel 62*a* of the image forming apparatus 1.

The user selects a print job to be immediately printed, Alexander.xls, using the input keys 61 or the touch panel 62*a*.

The CPU 111 of the image forming apparatus 1 transmits information on immediate printing of Alexander.xls to the NIC 202 of the external controller 200, which is connected to the image forming apparatus 1 by the NETWORK cable, via the NIC 131 of the image forming apparatus.

When the external controller 200 receives the information on immediate printing of Alexander.xls from the image forming apparatus 1, the external controller 200 changes a setting to immediately transmit image data of Alexander.xls and control information corresponding to the image data to the image forming apparatus 1. When the change for immediate transmission of the image data of Alexander.xls and the control information corresponding to the image data to the image forming apparatus 1 is completed, the external controller 200 transmits information indicating the print jobs after the setting for immediate printing of Alexander.xls from the NIC 202 of the external controller 200 to the image forming apparatus 1 via the NETWORK cable. The CPU 111 of the image forming apparatus 1 temporarily stores the information indicating the print jobs received from the external controller 200 in the NVM 114 or the ROM 113. The display control unit 120 of the image forming apparatus 1 performs display control to display the print jobs on the control panel 6. In this case, for example, it is also possible to display characters of the print job Alexander.xls in a light color to indicate that immediate printing is performed.

This makes it possible to immediately print a file, which is required to be printed quickly, using the input keys 61 or the touch panel 62*a* of the image forming apparatus 1 without applying loads to the image forming apparatus 1.

Figure 8:
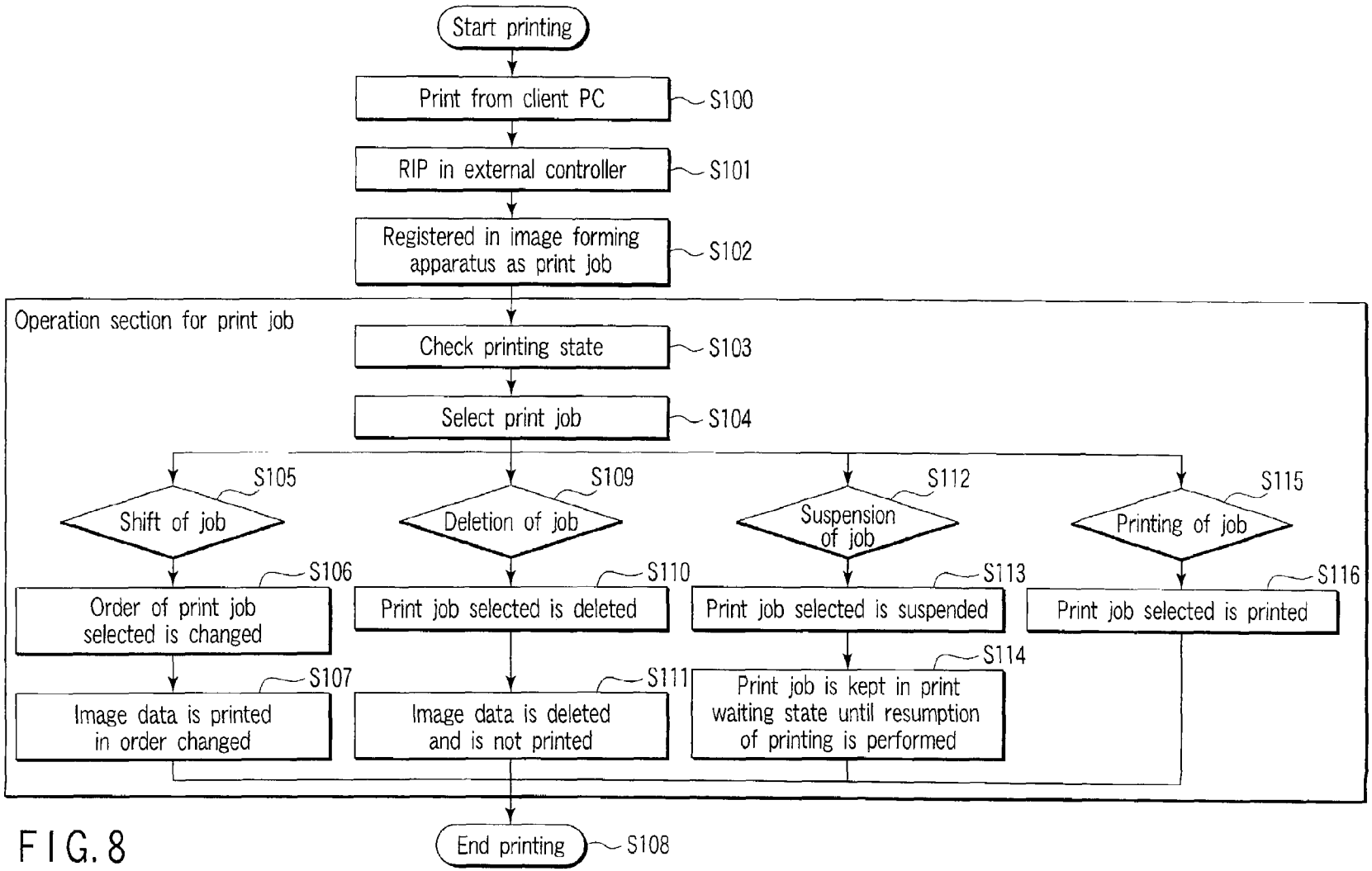
FIG. 8 is a flowchart showing operation in the control panel of the image forming apparatus according to the embodiment of the invention.

The selection of a print job in the image forming apparatus 1 explained above will be explained using a flowchart of FIG. 8.

Print data described in the PDL (Page Description Language) is transmitted from the client PC 300 to the external controller 200 (step S100). The external controller 200 interprets the PDL (Page Description Language) of the print data received using an RIP (Raster Image Processor), expand the print data into a raster image, and generates image data. The image data generated is transmitted from the Video ASIC 201 of the external controller 200 to the CMYK circuit 130 of the image forming apparatus 1 via the VIDEO cable. The external controller 200 transmits control information corresponding to the image data from the UART 203 of the image forming apparatus 1 to the UART 116 of the image forming apparatus 1 via the UART cable.

A not-shown CPU of the external controller 200 transmits information indicating print jobs from the NIC 202 of the external controller 200 to the NIC 202 of the image forming apparatus 1 via the NETWORK cable on the basis of an order of plural print requests transmitted from the client PC 300 (step S101).

The CPU 111 of the image forming apparatus 1 temporarily stores the information indicating the print jobs transmitted from the external controller 200 in the NVM 114 or the ROM 113 to make it possible to display the print jobs on the control panel 6 (step S102).

The display control unit 120 displays the print jobs on the control panel 6 in accordance with a display setting of the print jobs by the user. The user can check the display of the print jobs on the control panel 6 (step S103).

The user is capable of selecting a print job displayed on the control panel 6 and making a predetermined request concerning the print job selected (step S104).

It is assumed that the user selects one print job out of plural print jobs displayed on the control panel 6 and selects shift of a print order of the print job selected (step S105). The CPU 111 of the image forming apparatus 1 transmits information on the change of the print order of the print job selected from the NIC 131 of the image forming apparatus 1 to the NIC 202 of the external controller 200 via the NETWORK cable.

The external controller 200 performs control to transmit image data and control information corresponding to the image data stored in the not-shown storing unit of the external controller 200 to the image forming apparatus 1 in an order based on the information on the change of the print order. The external controller 200 transmits information indicating the print job after the change of the order from the NIC 202 of the external controller 200 to the NIC 131 of the image forming apparatus 1 via the NETWORK cable.

The CPU 111 of the image forming apparatus 1 temporarily stores the information indicating the print jobs after the change of the order in the NVM 114 or the ROM 113 to make it possible to display the print jobs on the control panel 6. An order of the print job selected is changed and displayed on the control panel 6 (step S106).

The printer unit 2 of the image forming apparatus 1 outputs image data in the order of the print jobs displayed on the control panel 6 (step S107). Printing of all the print jobs ends (step S108).

It is assumed that the user selects one print job out of the plural print jobs displayed on the control panel 6 and selects deletion of printing of the print job selected (step S109). The CPU 111 of the image forming apparatus 1 transmits information on the deletion of the print job selected from the NIC 131 of the image forming apparatus 1 to the NIC 202 of the external controller 200 via the NETWORK cable.

The external controller 200 performs control to delete the image data and the control information corresponding to the image data stored in the not-shown storing unit of the external controller 200 on the basis of the information on the deletion of the print job. The external controller 200 transmits information indicating the remaining print jobs after deleting the print job selected from the NIC 202 of the external controller 200 to the NIC 131 of the image forming apparatus 1 via the NETWORK cable.

The CPU 111 of the image forming apparatus 1 temporarily stores the information indicating the print jobs after deleting the print job selected in the NVM 114 or the ROM 113 to make it possible to display the print jobs on the control panel 6. The print job selected is deleted and the remaining print jobs are displayed on the control panel 6 (step S110).

Image data of the print job, for which deletion of printing is selected, is not printed and the printer unit 2 of the image forming apparatus 1 outputs image data in an order of the print jobs displayed on the control panel 6 (step S111). Printing of all the print jobs ends (step S108).

It is assumed that the user selects one print job out of the plural print jobs displayed on the control panel 6 and selects suspension of printing of the print job selected (step S112). The CPU 111 of the image forming apparatus 1 transmits information on the suspension of the print job selected from the NIC 131 of the image forming apparatus 1 to the NIC 202 of the external controller 200 via the NETWORK cable.

The external controller 200 performs control to transmit the image data and the control information corresponding to the image data stored in the not-shown storing unit of the external controller 200 to the image forming apparatus 1 on the basis of the information on the suspension.

The external controller 200 transmits information indicating the print jobs after setting the suspension of the print job selected from the NIC 202 of the external controller 200 to the NIC 131 of the image forming apparatus 1 via the NETWORK cable.

The CPU 111 of the image forming apparatus 1 stores the information indicating the print jobs after setting the suspension of the print job selected in the NVM 114 or the ROM 113 to make it possible to display the print jobs on the control panel 6. The print job selected is displayed in a suspended state on the control panel 6 (step S113).

The printer unit 2 of the image forming apparatus 1 keeps the print job, for which suspension is selected, in a print wait state until the user instructs resumption of printing (step S114). The printer unit 2 outputs the image data in an order of the print jobs displayed on the control panel 6 excluding the print job, for which suspension is selected, and print jobs of all the print jobs ends (step S108).

It is assumed that the user selects one print job out of the plural print jobs displayed on the control panel 6 and selects printing of the print job selected (step S115). The CPU 111 of the image forming apparatus 1 transmits print start information for immediately printing the print job selected from the NIC 131 of the image forming apparatus 1 to the NIC 202 of the external controller 200 via the NETWORK cable.

The external controller 200 performs control to start printing from the image data and the control information corresponding to the image data stored in the not-shown storing unit of the external controller 200 on the basis of the print start information. The external controller 200 transmits information indicating that the print job selected is printed from the NIC 202 of the external controller 200 to the NIC 131 of the image forming apparatus 1 via the NETWORK cable.

The CPU 111 of the image forming apparatus 1 temporarily stores the information indicating that the print job selected is in a printing state in the NVM 114 or the ROM 113 to make it possible to display the print jobs on the control panel 6. The print job selected is deleted and the remaining print jobs are displayed on the control panel 6.

The printer unit 2 of the image forming apparatus 1 prints image data of the print job, for which immediate printing is selected (step S116). The printer unit 2 outputs image data of the remaining print jobs displayed on the control panel 6 in an order of the print jobs displayed and printing of all the print jobs ends (step S108).

Since the UART cable is a cable for serial communication, if information with a large amount of data such as names of jobs is communicated, it is likely that deficiencies such as communication abnormality occur. It is possible to reduce loads of communication due to the UART cable and eliminate occurrence of deficiencies by performing operation of print jobs through the NETWORK cable.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

a first connecting unit configured to receive image data from an external controller;

a second connecting unit configured to receive control information from the external controller for subjecting the image data to output control, the control information corresponding to the image data;

a third connecting unit configured to communicate first print job information of the image data with the external controller; and a display unit configured to display the first print job information received by the third connecting unit, wherein the third connecting unit transmits a request for a predetermined operation on the first print job information displayed on the display unit and receives second print job information to which the predetermined operation is applied.

2. The apparatus of claim 1, further comprising an output unit configured to output plural image data corresponding to the second print job information in accordance with an order of the second print job information.

3. The apparatus of claim 2, wherein the predetermined operation is changing an order of a print job included in the first print job information.

4. The apparatus of claim 2, wherein the predetermined operation is deleting a print job included in the first print job information.

5. The apparatus of claim 2, wherein the predetermined operation is temporarily suspending a print job included in the first print job information.

6. The apparatus of claim 2, wherein the predetermined operation is immediately printing a print job included in the first print job information.

7. The apparatus of claim 1, wherein the control information is resolutions and numbers of outputs of the first image data and the second image data.

8. An image forming method comprising the steps of:

receiving image data;

receiving control information for subjecting the image data to output control, the control information corresponding to the image data;

receiving first print job information of the image data;

displaying the first print job information received;

transmitting a request for a predetermined operation on the first print job information; and receiving second print job information to which the predetermined operation is applied.

9. The method of claim 8, further comprising outputting the image data corresponding to the second print job information in accordance with an order of the second print job information.

10. The method of claim 9, wherein the predetermined operation is changing an order of a print job included in the first print job information.

11. The method of claim 9, wherein the predetermined operation is deleting a print job included in the first print job information.

12. The method of claim 9, wherein the predetermined operation is temporarily suspending a print job included in the first print job information.

13. The method of claim 9, wherein the predetermined operation is immediately printing a print job included in the first print job information.

14. The method of claim 8, wherein the control information is resolutions and numbers of outputs of the first image data and the second image data.

15. An image forming system comprising:

a client computer that transits print data;

an external controller that is connected to the client computer via a network and expands print data transmitted from the client computer to generate image data and control information for subjecting the image data to output control; and an image forming apparatus including:

a first connecting unit configured to receive the image data, the first connecting unit being connected to the external controller;

a second connecting unit configured to receive the control information;

a third connecting unit configured to communicate first print job information with the external controller; and a display unit configured to display the first print job information received by the third connecting unit wherein the third connecting unit transmits a request for a predetermined operation on the first print job information displayed on the display unit and receives second print job information to which the predetermined operation is applied.

* * * * *